US007365502B2

(12) United States Patent
Meng et al.

(10) Patent No.: US 7,365,502 B2
(45) Date of Patent: Apr. 29, 2008

(54) DEVICE FOR DRIVING LIGHT SOURCES

(75) Inventors: Tien-Hsiang Meng, Tu-Cheng (TW); Chi-Hsiung Lee, Tu-Cheng (TW); Che-Chen Fan Chiang, Tu-Cheng (TW); Kuo-Chi Liu, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 152 days.

(21) Appl. No.: 11/473,789

(22) Filed: Jun. 23, 2006

(65) Prior Publication Data

US 2006/0290297 A1 Dec. 28, 2006

(30) Foreign Application Priority Data

Jun. 24, 2005 (CN) ..... 2005 1 0035550

(51) Int. Cl.
*H05B 37/02* (2006.01)

(52) U.S. Cl. ..... 315/291; 315/282; 345/102

(58) Field of Classification Search ..... 315/209 R, 315/224, 276, 282, 283, 291, 307, 312, 325; 345/87, 102, 204; 361/58
See application file for complete search history.

(56) References Cited

U.S. PATENT DOCUMENTS 6,420,839 B1 * 7/2002 Chiang et al. ..... 315/311
6,534,934 B1 * 3/2003 Lin et al. ..... 315/312
6,781,325 B2 * 8/2004 Lee ..... 315/282

* cited by examiner

*Primary Examiner*—Thuy V. Tran
*Assistant Examiner*—Jimmy T Vu
(74) *Attorney, Agent, or Firm*—Morris Manning Martin LLP; Tim Tingkang Xia, Esq.

(57) ABSTRACT

A device for driving a light source ($L_{11}$) including a first lamp ($a_1$) and a second lamp ($a_2$) includes two power supply circuits, two transformers (12, 12'), and two current balancing components (13, 13'). Each power supply circuit includes a direct current (DC) power source (10 or 10') and a DC to alternating current (AC) converter (11 or 11'). The DC/AC converters convert DC signals received from the corresponding DC power sources to AC signals. The transformers correspondingly convert the AC signals to other AC signals. The current balancing components are respectively connected between the transformers and the lamps. The feedback circuits correspondingly feed back current flowing through the lamps to the DC/AC converters.

18 Claims, 5 Drawing Sheets

DEVICE FOR DRIVING LIGHT SOURCES

BACKGROUND

1. Field of the Invention

The invention relates to electronic driving devices, and particularly to a device for driving a light source such as a discharge lamp of a liquid crystal display (LCD) panel.

2. Related Art

Conventionally, discharge lamps such as cold cathode fluorescent lights (CCFLs) have been used as light sources for liquid crystal display (LCD) panels. Because a plurality of discharge lamps are required for sufficient light intensity in each LCD, high voltages must be added to two ends of each discharge lamp in a large LCD panel. However, impedance differences of the discharge lamps cause unbalanced current flowing through the discharge lamps. The imbalance not only affects luminance uniformity of the LCD panels, but also shortens lifetime of discharge lamps due to large current.

To solve the above problem, a conventional device for driving discharge lamps utilizes a plurality of transformers to balance the current flowing through the discharge lamps.

FIG. 5 is a conventional device for driving discharge lamps. The device includes two direct current (DC) power sources 50 and 50', two DC to alternating current (AC) converters 51 and 51', a plurality of transformers $T_{5n}$ and $T_{5n}'$ (n=1, 2, 3, . . . , n), a plurality of feedback circuits 52 and 52', and a plurality of discharge lamps $L_{5n}$(n=1, 2, 3, . . . , n). The device is divided into a left part and a right part with the discharge lamps $L_{5n}$(n=1, 2, 3, . . . , n) disposed therebetween. Components of the left part and the right part are the same. The DC/AC converters 51 and 51' respectively convert DC signals received from the DC power sources 50 and 50' to AC signals. The transformers $T_{5n}$ and $T_{5n}'$(n=1, 2, 3, . . . , n) convert the AC signals to sine wave signals respectively added to two ends of each discharge lamp. The feedback circuits 52 and 52' feed back the current flowing through each discharge lamp to the DC/AC converters 51 and 51'.

In the conventional device, the current flowing through the discharge lamps is balanced by the transformers. However, cost of the device is high, and a circuit structure is more complex due to more transformers being used. In addition, a yield rate is lowered when the devices are mass-produced.

SUMMARY

An exemplary embodiment of the present invention provides a device for driving a light source including a first lamp and a second lamp. The device includes a first power supply circuit, a second power supply circuit, a first transformer, a second transformer, a first current balancing component and a second current balancing component.

The first transformer and the second transformer are respectively connected to the first power supply circuit and the second power supply circuit, for converting signals respectively received from the first power supply circuit and the second power supply circuit to alternating current (AC) signals. The first current balancing component and the second current balancing component are used for balancing current flowing through the light source, and respectively have two input ends and two output ends.

The two input ends of the first current balancing component are jointly connected to the first transformer, and the two output ends of the first current balancing components are respectively for connection to the first lamp and the second lamp. The two input ends of the second current balancing component are jointly connected to the second transformer, and the two output ends of the second current balancing component are respectively for connection to the first lamp and the second lamp.

The first feedback circuit is connected between the first transformer and the first power supply circuit, for feeding back current flowing through the light source. The second feedback circuit is connected between the second transformer and the second power supply circuit, for also feeding back current flowing through the light source.

Another exemplary embodiment of the present invention provides a larger device for driving a plurality of light sources. The light sources respectively include a first lamp and a second lamp. The device includes a first power supply circuit, a second power supply circuit, a first transformer, a second transformer, a plurality of first current balancing components and a plurality of second current balancing components, a first feedback circuit and a second feedback circuit. A number of the light sources, the first current balancing components and the second current components is respectively defined as n, where n is an integer from 1 to (k+1). Each of the first current balancing components and the second current balancing components has two input ends and two output ends.

The first transformer and the second transformer are respectively connected to the first power supply circuit and the second power supply circuit, for converting signals respectively received from the first power supply circuit and the second power supply circuit to AC signals. The first current balancing components and the second current balancing components are used for balancing current flowing through the light sources.

The two input ends of the first current balancing components are jointly connected to the first transformer, and the two output ends of the $k^{th}$ first current balancing components are respectively for connection to the first lamp and the second lamp of the $k^{th}$ light source. The two input ends of the second current balancing components are jointly connected to the first transformer, and the two output ends of the $k^{th}$ second current balancing components are respectively for connection to the second lamp in the $k^{th}$ light source and the first lamp in the $(k+1)^{th}$ light source, and the two output ends of the $(k+1)^{th}$ second current balancing component are respectively for connection to the second lamp in the $k^{th}$ light source and the first lamp in the first light source.

The first feedback circuit is connected between the first transformer and the first power supply circuit, for feeding back current flowing through the light sources. The second feedback circuit is connected between the second transformer and the second power supply circuit, for also feeding back current flowing through the light sources.

Another exemplary embodiment of the present invention provides a larger device for driving a plurality of light sources. The device includes a power supply circuit, a second power supply circuit, a first transformer, a second transformer, a plurality of first current balancing components and a plurality of second current balancing components, a first feedback circuit and a second feedback circuit. A number of the light source, the first current balancing components and the second current balancing components is respectively defined as n, where n is an integer from 1 to (k+1). Each of the first current balancing components and the second current balancing components has two input ends and two output ends. The first light source to the $k^{th}$ light source respectively includes a first lamp and a second lamp, and the $(k+1)^{th}$ light source includes only a lamp.

The first transformer and the second transformer are respectively connected to the first power supply circuit and the second power supply circuit, for converting signals respectively received from the first power supply circuit and the second power supply circuit to AC signals. The first current balancing components and the second current balancing component are used for balancing current flowing through the light sources.

The two input ends of the first current balancing components are jointly connected to the first transformer, and the two output ends of the $k^{th}$ first current balancing component are respectively connected to the first lamp and the second lamp of the $k^{th}$ light source, and the lamp of the $(k+1)^{th}$ light source is connected to the end of the secondary winding of the first transformer. The two input ends of the second current balancing components are jointly connected to the second transformer, and the two output ends of the $k^{th}$ second current balancing component are for respectively connection to the second lamp of the $k^{th}$ light source and the lamp of the $(k+1)^{th}$ light source, and the first lamp of the first light source is connected to the second transformer.

The first feedback circuit is connected between the first transformer and the first power supply circuit, for feeding back current flowing through the light sources. The second feedback circuit is connected between the second transformer and the second power supply circuit, for also feeding back current flowing through the light sources.

Other advantages and novel features will be drawn from the following detailed description of preferred embodiments of the present invention with the attached drawings, in which:

DETAILED DESCRIPTION OF THE EMBODIMENTS

Figure 1:
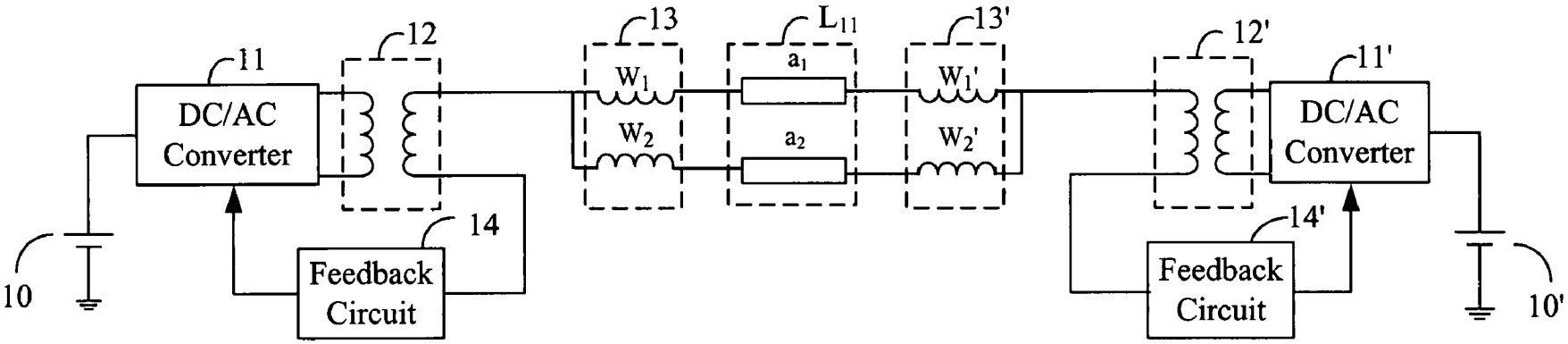
FIG. 1 is a block diagram of a device for driving light sources in accordance with a first exemplary embodiment of the invention.

FIG. 1 is a diagram of a device for driving light sources of an exemplary embodiment of the invention related to an illumination assembly. The device includes two power supply circuits, two transformers 12 and 12', two current balancing components 13 and 13', two feedback circuits 14 and 14', and a light source $L_{11}$ including a first lamp $a_1$ and a second lamp $a_2$. In the exemplary embodiment, a power supply circuit includes a direct current (DC) power source 10 and a DC to alternating current (AC) converter 11 (hereinafter, DC/AC converter), and another power supply circuit includes a DC power supply 10' and a DC/AC converter 11'. In the exemplary embodiment, the current balancing components 13 and 13' respectively include a common-mode choke with two input ends and two output ends.

In the exemplary embodiment, the device is divided into a left part and a right part with the light source $L_{11}$ disposed therebetween. Components of the left part and the right part are the same, so only the left part of the device is described hereinafter.

The DC/AC converter 11 converts DC signals received from the DC power source 10 to AC signals. The transformer 12, connected to the DC/AC converter 11, converts the AC signals to another AC signals transmitted to the light source L11 via the current balancing components 13. In the exemplary embodiment, the AC signals output from the DC/AC converter 11 are square wave signals, and the AC signals output from the transformer 12 are sine wave signals. The current balancing component 13 is used for balancing current flowing through the lamps $a_1$ and $a_2$. The feedback circuit 14 is connected between the transformer 12 and the DC/AC converter 11 for feeding back total current flowing through the lamps $a_1$ and $a_2$ to the DC/AC converter 11. In the exemplary embodiment, the feedback circuit 14 includes a dual diode circuit.

In alternative exemplary embodiments, the feedback circuit 14 can be other circuits. Signals output from the DC/AC converter 11 are varied according to the signals output from the feedback circuit 14, directly affecting brightness of the lamps $a_1$ and $a_2$.

In the exemplary embodiment, the DC/AC converter 11 may be a full bridge circuit, a half bridge circuit, a push-pull circuit, or a Royer circuit.

In the exemplary embodiment, phases of the AC signals respectively output from the transformers 12 and 12' are opposite. That is, the AC signals output from the transformer 12' are negative while the AC signals output from the transformer 12 are positive, and vice versa. Therefore, the current flowing through the lamps $a_1$ and $a_2$ is two times as much as the current generated only by the left part or the right part.

In alternative exemplary embodiments, the device can include only one DC power source, either 10 or 10', supplying DC power to both the left part and the right part.

In the exemplary embodiment, the current balancing component 13 comprises a first winding $W_1$ and a second winding $W_2$. Two input ends of the current balancing component 13 are at a side of the first winding $W_1$ and a second winding $W_2$, and two output ends of the current balancing component 13 are at another side of the first winding $W_1$ and a second winding $W_2$. The input ends of the current balancing component 13 are jointly connected to the transformer 12, and the output ends of the current balancing component 13 are respectively connected to the lamp $a_1$ and lamp $a_2$. A number of turns N1 of the first winding $W_1$ and a number of turns N2 of the second winding $W_2$ are the same. Inductance L1 of the first winding $W_1$ and inductance L2 of the second winding $W_2$ are substantially equal in magnitude. The current flowing through the first winding $W_1$ is defined as I1, and the current flowing through the second winding $W_2$ is defined as I2. The current I1 and I2 are equal in magnitude because the N1 is equal to the N2. Based on Lenz's law, mutual inductance between the first winding $W_1$ and the second winding $W_2$ is M12 and M21. The M12 and the M21 are equal in magnitude, and both of them are equal to the L1 and L2. An impedance of the lamp $a_1$ is defined as R1, and an impedance of the lamp $a_2$ is defined as R2. If the R1 is not equal to the R2, basic equations of voltages in accordance with the transformer 12 are as follows:

$$V=(sL1+R1)*I1-sM12I2 \quad (1)$$

$$V=(sL2+R2)*I2-sM21I1 \quad (2)$$

In the exemplary embodiment, the V is value of voltages output from the transformer 12. Then, a following equation is obtained from equations (1) and (2)

$$(2*sL1+R1)*I2=(2*sL2+R2)*I1 \quad (3)$$

An inequality of (2*sL1=2*sL2)>>(R1 and R2) is obtained from equation (3). That is, both of 2*sL1 and 2*sL2 are greater than the largest value of the R1 and the R2. In the exemplary embodiment, value of the s is (2π f), in which f is a frequency of the current flowing through the lamps $a_1$ and lamp $a_2$.

Figure 2:
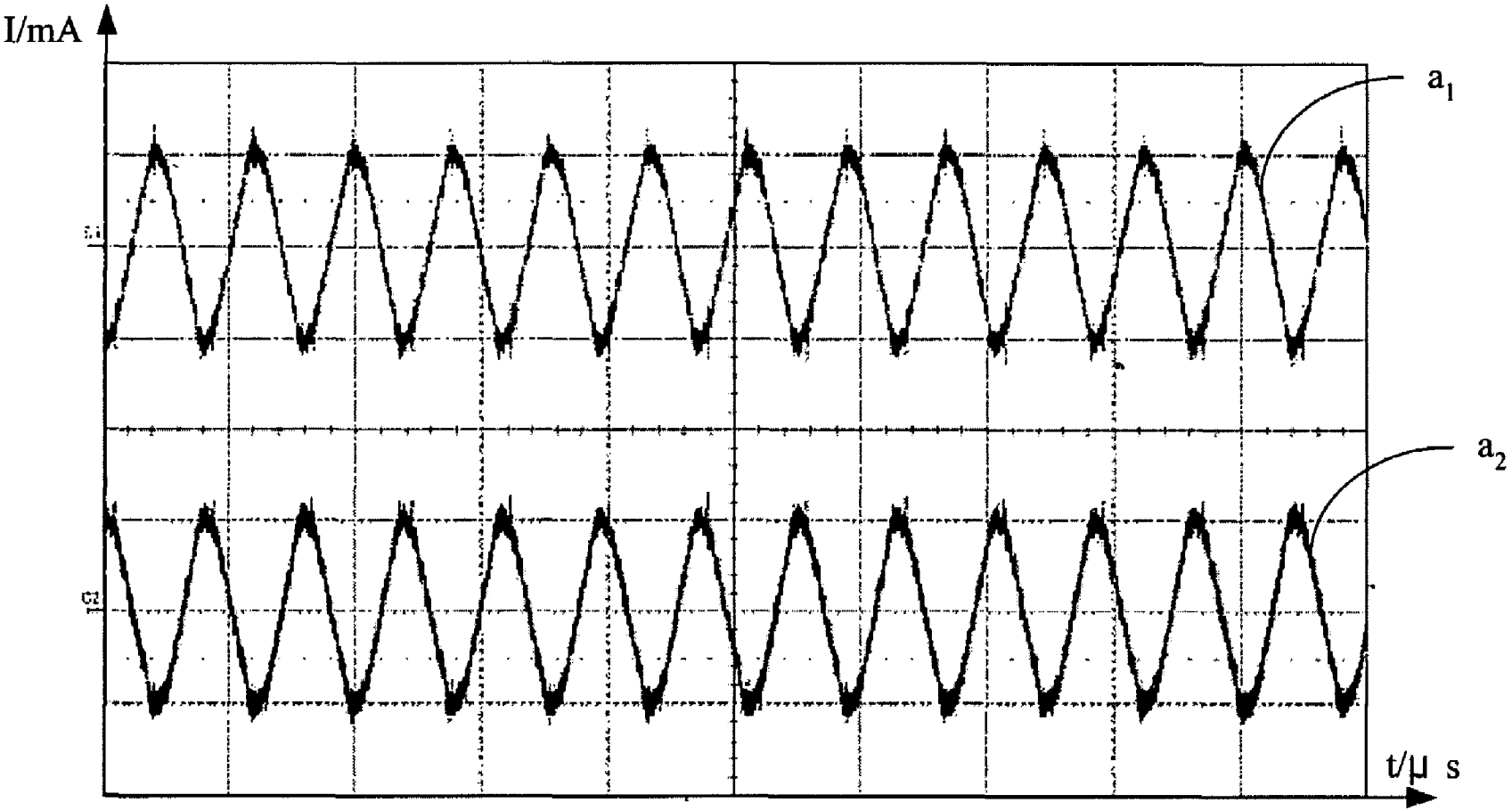
FIG. 2 is a diagram of current flowing through two lamps of FIG. 1.

FIG. 2 is a diagram of the current flowing through the two lamps $a_1$, $a_2$ of FIG. 1 with respect to time t. The current flowing through the lamps $a_1$ and $a_2$ are almost equal in magnitude. It can be seen that the circuit structure in FIG. 1 can balance the currents flowing through the lamps $a_1$ and $a_2$ respectively.

Figure 3:
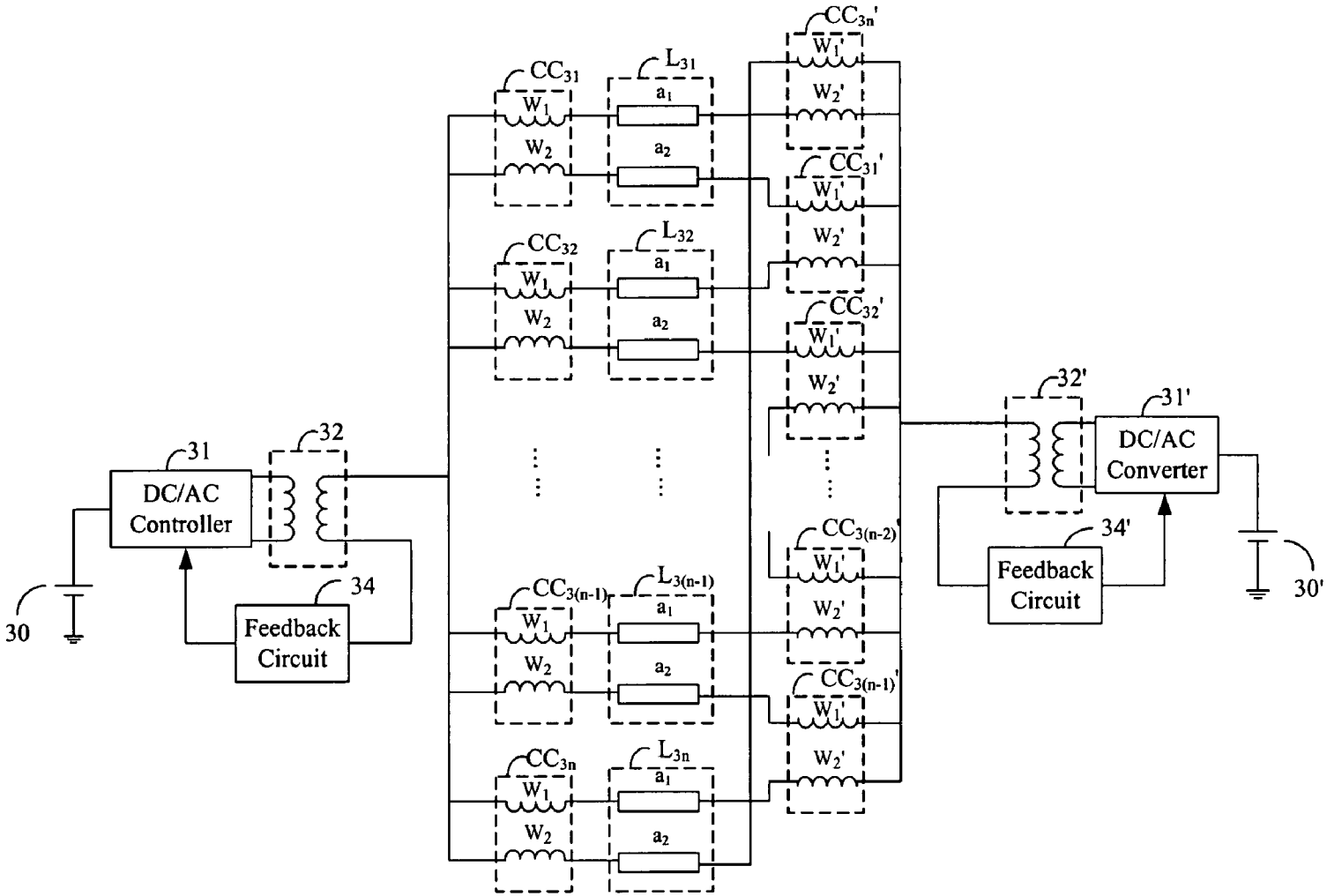
FIG. 3 is a block diagram of a device for driving a plurality of light sources in accordance with a second exemplary embodiment of the invention.

FIG. 3 is a diagram of a device for driving a plurality of light sources of a second exemplary embodiment of the present invention. In the exemplary embodiment, the device includes at least two power supply circuits, at least two transformers 32 and 32', at least two feedback circuits 34 and 34', a plurality of current balancing components $CC_{3n}$ and $CC_{3n}'$ (n=1, 2, 3, . . . , n), and a plurality of light sources $L_{3n}$ (n=1, 2, 3, . . . , n). In the exemplary embodiment, a power supply circuit includes a DC power source 30 and a DC/AC converter 31, and another power supply circuit includes a DC power source 30' and a DC/AC converter 31'. Each of the current balancing components includes a first winding $W_1$ and a second winding $W_2$, and each of the light sources includes a first lamp $a_1$ and a second lamp $a_2$. In the exemplary embodiment, the current balancing components $CC_{3n}$ and $CC_{3n}'$ (n=1, 2, 3, . . . , n) respectively includes a common-mode choke with two input ends and two output ends.

In the exemplary embodiment, the DC/AC converters 31 and 31' may be a full-bridge circuit, a half-bridge circuit, a push-pull circuit, or a Royer circuit.

In the exemplary embodiment, connections between the light sources $L_{3n}$ (n=1, 2, 3, . . . , n) and the current balancing components $CC_{3n}'$ (n=1, 2, 3, . . . , n) are different from those of the light sources $L_{3n}$ (n=1, 2, 3, . . . , n) and the current balancing components $CC_{3n}$ (n=1, 2, 3, . . . , n). The device is divided into a left part and a right part with the light source $L_{3n}$ (n=1, 2, 3, . . . , n) disposed therebetween. In the left part, the input ends of the current balancing components $CC_{3n}$ (n=1, 2, 3, . . . , n) are jointly connected to the transformer 32, and the output ends of the current balancing components $CC_{3n}$ (n=1, 2, 3, . . . , n) are respectively connected to a first lamp $a_1$ and a second lamp $a_2$ of a corresponding light source $L_{3n}$ (n=1, 2, 3, . . . , n). That is, a first winding $W_1$ and a second winding $W_2$ of a current balancing component $CC_{31}$ are respectively connected to a first lamp $a_1$ and a second lamp $a_2$ of a light source $L_{31}$, a first winding $W_1$ and a second winding $W_2$ of a current balancing component $CC_{32}$ are respectively connected to a first lamp $a_1$ and a second lamp $a_2$ of a light source $L_{32}$, and so on through to a first winding $W_1$ and a second winding $W_2$ of a current balancing component $CC_{3n}$ are respectively connected to a first lamp $a_1$ and a second lamp $a_2$ of a light source $L_{3n}$. Therefore, the current balancing component $CC_{31}$, balances current flowing through the two lamps in the light source $L_{31}$, the current balancing component $CC_{32}$ balances current flowing through the two lamps in the light source $L_{32}$, and so on through to the current balancing component $CC_{3n}$ balances current flowing through the two lamps in the light source $L_{3n}$.

In the right part, the input ends of the current balancing components $CC_{3n}'$ (n=1, 2, 3, . . . , n) are also jointly connected to the transformer 32'. However, a first winding $W_1'$ and a second winding $W_2'$ of a current balancing component $CC_{31}'$ are respectively connected to the lamp $a_2$ of the light source $L_{31}$ and the lamp $a_1$ of the light source $L_{32}$, a first winding $W_1'$ and a second winding $W_2'$ of a current balancing component $CC_{32}'$ are respectively connected to the lamp $a_2$ of the light source $L_{32}$ and a lamp $a_1$ of the light source $L_{33}$, and so on through to a first winding $W_1'$ and a second winding $W_2'$ of a current balancing component $CC_{3n}'$ are respectively connected to the lamp $a_2$ of the light source $L_{3n}$ and the lamp $a_1$ of the light source $L_{31}$. Therefore, the current balancing component $CC_{31}'$ balances current flowing through the lamp $a_2$ of the light source $L_{31}$ and the lamp $a_1$ of the light source $L_{32}$, the current balancing component $CC_{32}'$ balances current flowing through the lamp $a_2$ of the light source $L_{32}$ and the lamp $a_1$ of the light source $L_{33}$, and so on through to the current balancing component $CC_{3n}'$ balances current flowing through the lamp $a_2$ of the light source $L_{3n}$ and the lamp $a_1$ of the light source $L_{31}$.

In conclusion, the current balancing components $CC_{3n}$ and $CC_{3n}'$ (n=1, 2, 3, . . . , n) balances the current flowing through each lamp of the light sources $L_{3n}$ (n=1, 2, 3, . . . , n).

Similarly, in the exemplary embodiment, phases of the AC signals output from the transformers 32 and 32' are opposite. Therefore, current flowing through the lamps $a_1$ and $a_2$ is two times as much as the current generated only by the left part or the right part.

Figure 4:
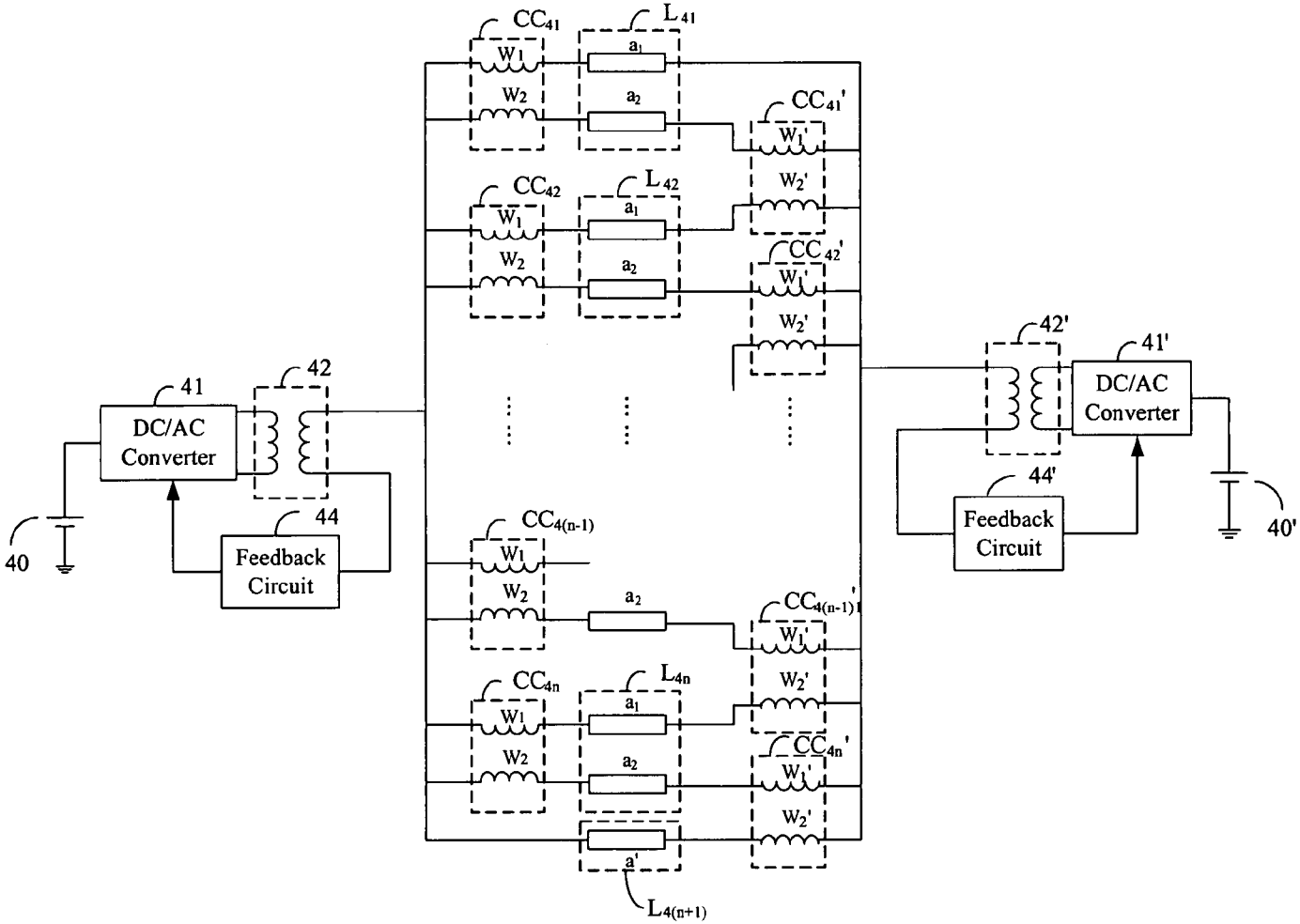
FIG. 4 is a block diagram of a device for driving a plurality of light sources in accordance with a third exemplary embodiment of the invention.
Figure 5:
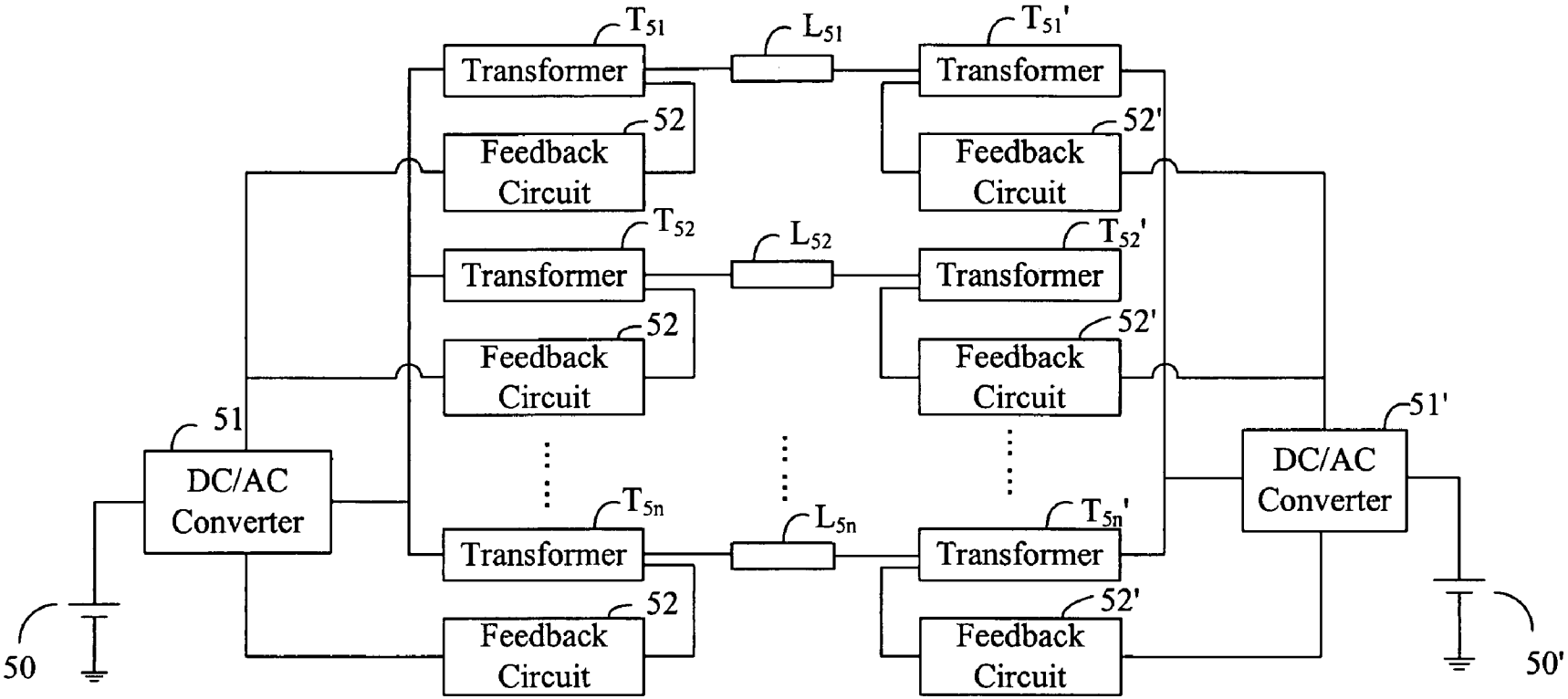
FIG. 5 (Related Art)
FIG. 5 is a block diagram of a known device for driving discharge lamps.

FIG. 4 is a diagram of a device for driving a plurality of light sources of a third exemplary embodiment of the present invention. In the exemplary embodiment, the device includes a plurality of light sources $L_{4(n+1)}$ (n=1, 2, 3, . . . , n). The first light source $L_{4n}$ (n=1, 2, 3, . . . , n) respectively includes a first lamp $a_1$ and a second lamp $a_2$, and the light source $L_{4(n+1)}$ only includes a lamp a'. Connections between the current balancing components $CC_{4n}$ (n=1, 2, 3, . . . , n) and the light source $L_{4(n+1)}$ (n=1, 2, 3, . . . , n) are different from those of the current balancing components $CC_{4n}'$ (n=1, 2, 3, . . . , n) and the light source $L_{4(n+1)}$ (n=1, 2, 3, . . . , n). In the exemplary embodiment, the device is divided into a left part and a right part with the light source $L_{4(n+1)}$ (n=1, 2, 3, . . . , n) disposed therebetween.

In the left part, the input ends of the current balancing components $CC_{4n}$ (n=1, 2, 3, . . . , n) are jointly connected to the transformer 42, and the output ends of the current balancing components $CC_{4n}$ (n=1, 2, 3, . . . , n) are respectively connected to a corresponding light source $L_{4n}$ (n=1, 2, 3, . . . , n). That is, the first winding $W_1$ and a second winding $W_2$ of the current balancing component $CC_{41}$ are respectively connected to the lamp $a_1$ and the lamp $a_2$ of the light source $L_{41}$, the first winding $W_1$ and the second winding $W_2$ of the current balancing component $CC_{42}$ are respectively connected to the lamp $a_1$ and the lamp $a_2$ of the light source $L_{42}$, and so on through to the first winding $W_1$ and a second winding $W_2$ of the current balancing component $CC_{4n}$ are respectively connected to the lamp $a_1$ and the lamp $a_2$ of the light source $L_{4n}$. In addition, the lamp a' of the light source $L_{4(n+1)}$ is directly connected to the first transformer 42. Therefore, the current balancing components $CC_{4n}$ (n=1, 2, 3, . . . , n) balances the currents flowing through the lamp $a_1$ and the lamp $a_2$ of each light source.

In the right part, the input ends of the current balancing components $CC_{4n}'$ (n=1, 2, 3, . . . , n) are also jointly connected to the transformer 42'. However, the first winding $W_1'$ and a second winding $W_2'$ of the current balancing component $CC_{41}'$ are respectively connected to the lamp $a_2$ of the light source $L_{41}$ and lamp $a_1$ of the light source $L_{42}$, the first winding $W_1'$ and the second winding $W_2'$ of the current balancing component $CC_{42}'$ are respectively connected to the lamp $a_2$ of the light source $L_{42}$ and the lamp $a_1$ of the light source $L_{43}$, and so on through to the first winding $W_1'$ and the second winding $W_2'$ of the current balancing component $CC_{4n}'$ are respectively connected to the lamp $a_2$ of the light source $L_{4n}$ and the lamp a' of the light source $L_{4(n+1)}$. In addition, the lamp $a_1$ of the light source $L_{41}$ is directly connected to the first transformer 32'. Therefore, the current balancing components $CC_{4n}'$ (n=1, 2, 3, . . . , n) balance the currents flowing through the lamp $a_2$ of one light source and the lamp $a_1$ of another light source.

In conclusion, the current balancing components $CC_{4n}$ and $CC_{4n}'$ (n=1, 2, 3, . . . , n) balance the currents flowing through each lamp of the light sources.

Similarly, in the exemplary embodiment, phases of the AC signals output from the transformers 42 and 42' are opposite. Therefore, current flowing through the lamps $a_1$ and $a_2$ is two times as much as the current generated only by the left part or the right part.

Thus, the invention minimizes the number of transformers such that assembly and material costs can be greatly reduced and the circuitry structure is simplified while current flowing through the light sources is balanced.

While particular embodiments of the invention have been described above, it should be understood that it has been presented by way of examples only and not by way of limitation. Thus the breadth and scope of the invention should not be limited by the above-described exemplary embodiments, but should be defined only in accordance with the following claims and their equivalents.

We claim:

1. An illumination assembly comprising:

a plurality of lamps of said assembly to be powered for illumination;

a first power supply circuit electrically connected to one end of each lamp of said plurality of lamps for powering said each lamp;

a second power supply circuit electrically connected to the other end of said each lamp for powering said each lamp together with said first power supply circuit;

a plurality of first current balancing components electrically connected between said first power supply circuit and said each lamp for balancing electrical currents from said first power supply circuit through said each lamp, each of said plurality of first current balancing components electrically connected with said each lamp and a first neighboring lamp of said each lamp in order to simultaneously balance said electrical currents through said each lamp and said first neighboring lamp thereof; and a plurality of second current balancing components electrically connected between said second power supply circuit and said each lamp for balancing electrical currents from said second power supply circuit through said each lamp, each of said plurality of second current balancing components electrically connected with said each lamp and a second neighboring lamp of said each lamp other than said first neighboring lamp thereof in order to simultaneously balance said electrical currents through said each lamp and said second neighboring lamp thereof.

2. The assembly as recited in claim 1, further comprising a first transformer electrically connected between said first power supply circuit and said plurality of first current balancing components, and a second transformer electrically connected between said second power supply circuit and said plurality of second current balancing components, phases of signal outputs from said first transformer and said second transformer being opposite.

3. The assembly as recited in claim 1, wherein said each of said plurality of first current balancing components and said each of said plurality of second current balancing components respectively comprises a common-mode choke.

4. The assembly as recited in claim 3, wherein said common-mode choke comprises a first winding and a second winding respectively corresponding to said each lamp and said first/second neighboring lamp thereof, and a number of turns of said first winding and a number of turns of said second winding are equal to each other.

5. The assembly as recited in claim 1, wherein said first power supply circuit and said second power supply circuit respectively comprises:

a direct current (DC) power source; and a DC to alternating-current (AC) converter for converting DC signals, received from said DC power source, to AC signals for output.

6. The assembly as recited in claim 2, further comprising a first feedback circuit electrically connected between said first power supply circuit and said first transformer, and a second feedback circuit electrically connected between said second power supply circuit and said second transformer, said first and second feedback circuits respectively comprising a dual diode circuit.

7. A device for driving a plurality of light sources, each comprising a first lamp and a second lamp, wherein the number of the light sources is defined as n, where n is an integer from 1 to (k+1), and k is an integer, comprising:

a first power supply circuit;

a second power supply circuit;

a first transformer connected to the first power supply circuit, for converting signals received from the first power supply circuit to AC signals;

a second transformer connected to the second power supply circuit, for converting signals received from the second power supply circuit to AC signals;

a plurality of first current balancing components for balancing current flowing through the light sources, the first current balancing components respectively comprising two input ends and two output ends, wherein the number of first current balancing components is defined as n, where n is an integer from 1 to (k+1), and k is an integer; wherein the two input ends of the first current balancing components are jointly connected to the first transformer, and the two output ends of the $k^{th}$ first current balancing components are respectively coupled to the first lamp and the second lamp of the $k^{th}$ light source;

a plurality of second current balancing components for balancing current flowing through the light sources, the second current balancing components respectively comprising two input ends and two output ends, wherein the number of second current balancing components is defined as n, where n is an integer from 1 to (k+1), and k is an integer; wherein the two input ends of the second current balancing components are jointly connected to the first transformer, and the two output ends of the $k^{th}$ second current balancing components are respectively coupled to the second lamp in the $k^{th}$ light source and the first lamp in the $(k+1)^{th}$ light source, and the two output ends of the $(k+1)^{th}$ second current balancing component are respectively for connection to the second lamp in the $k^{th}$ light source and the first lamp in the first light source;

a first feedback circuit, connected between the first transformer and the first power supply circuit, for feeding back current flowing through the light sources; and a second feedback circuit, connected between the second transformer and the second power supply circuit, for feeding back current flowing through the light sources.

8. The device as recited in claim 7, wherein the first feedback circuit and the second feedback circuit respectively comprises a dual diode circuit.

9. The device as recited in claim 7, wherein the first current balancing component and the second balancing component respectively comprises a common-mode choke.

10. The device as recited in claim 9, wherein the common-mode choke comprises a first winding and a second winding, wherein a number of turns of the first winding and those of the second winding are equal.

11. The device as recited in claim 7, wherein the first power supply circuit and the second supply circuit respectively comprises:

a DC power source; and a DC to AC converter for converting DC signals received from the DC power source to another AC signals.

12. The device as recited in claim 7, wherein phases of the AC signals output from the first transformer and the second transformer are opposite.

13. A device for driving a plurality of light sources, wherein the number of the light sources is defined as n, where n is an integer from 1 to (k+1), and k is an integer; and the first light source to the $k^{th}$ light source respectively comprises a first lamp and a second lamp, and the $(k+1)^{th}$ light source comprises only one lamp, comprising:

a first power supply circuit;

a second power supply circuit;

a first transformer, connected to the first power supply circuit, for converting signals received from the first power supply circuit to AC signals;

a second transformer, connected to the second power supply circuit, for converting signals received from the second power supply circuit to AC signals;

a plurality of first current balancing components for balancing current flowing through the light sources, the first current balancing components respectively comprising two input ends and two output ends, wherein the number of first current balancing components is defined as n, where n is an integer from 1 to (k+1), and k is an integer;

wherein the two input end of the first current balancing components are jointly connected to the first transformer, and the two output ends of the $k^{th}$ first current balancing component are respectively connected to the first lamp and the second lamp of the $k^{th}$ light source, and the lamp in the $(k+1)^{th}$ light source is connected to the end of the secondary winding of the first transformer;

a plurality of second current balancing components for balancing current flowing through the light sources, the second current balancing components respectively comprising two input ends and two output ends, wherein the number of second current balancing components is defined as n, where n is an integer from 1 to (k+1), and k is an integer; wherein the two input ends of the second current balancing components are jointly connected to the second transformer, and the two output ends of the $k^{th}$ second current balancing component are coupled to the second lamp in the $k^{th}$ light source and the lamp in the $(k+1)^{th}$ light source, and the first lamp in the first light source is connected to the end of the secondary winding of the second transformer;

a first feedback circuit connecting between the first transformer and the first power supply circuit, for feeding back current flowing through the light sources; and a second feedback circuit connecting between the secondary winding of the second transformer and the second power supply circuit, for feeding back current flowing through the light sources.

14. The device as recited in claim 13, wherein the first feedback circuit and the second feedback circuit respectively comprises a dual diode circuit.

15. The device as recited in claim 13, wherein the first current balancing component and the second balancing component respectively comprises a common-mode choke.

16. The device as recited in claim 15, wherein the common-mode choke comprises a first winding and a second winding, wherein a number of turns of the first winding and those of the second winding are equal.

17. The device as recited in claim 13, wherein the first power supply circuit and the second supply circuit respectively comprises:

a DC power source; and a DC to AC converter for converting DC signals received from the DC power source to another AC signals.

18. The device as recited in claim 13, wherein phases of the AC signals output from the first transformer and the second transformer are opposite.

* * * * *